US008061409B2

(12) United States Patent
Iwasaki et al.

(10) Patent No.: US 8,061,409 B2
(45) Date of Patent: Nov. 22, 2011

(54) MOLD

(75) Inventors: Junichi Iwasaki, Toyokawa (JP); Yutaka Hagata, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 169 days.

(21) Appl. No.: 12/444,086

(22) PCT Filed: Jun. 22, 2007

(86) PCT No.: PCT/JP2007/063059

§ 371 (c)(1),
(2), (4) Date: Apr. 2, 2009

(87) PCT Pub. No.: WO2008/047502

PCT Pub. Date: Apr. 24, 2008

(65) Prior Publication Data

US 2009/0321612 A1 Dec. 31, 2009

(30) Foreign Application Priority Data

Oct. 16, 2006 (JP) ..... 2006-281354

(51) Int. Cl.
*B22C 9/02* (2006.01)
*B29C 33/00* (2006.01)

(52) U.S. Cl. ..... 164/339; 164/29; 164/364; 249/134; 249/135; 425/408; 425/412; 425/415

(58) Field of Classification Search ..... 425/192 R, 425/193, 195, 595, 408, 412, 415, 423; 164/133, 164/284, 370, 137, 349, 364, 29, 339; 249/134, 249/135

See application file for complete search history.

(56) References Cited

U.S. PATENT DOCUMENTS 2,633,603 A * 4/1953 Huse ..... 425/215
3,540,516 A * 11/1970 Taccone ..... 164/61
3,968,829 A * 7/1976 Nakata et al. ..... 164/160.2
4,049,041 A 9/1977 Nikolov et al.
4,775,130 A * 10/1988 Von Holdt ..... 249/144
4,856,977 A * 8/1989 Von Holdt ..... 425/468

(Continued)

FOREIGN PATENT DOCUMENTS

EP 1829631 A2 * 9/2007

(Continued)

OTHER PUBLICATIONS

Translation of JP 08-117966.*

(Continued)

*Primary Examiner* — Joseph Del Sole
*Assistant Examiner* — Dimple Bodawala
(74) *Attorney, Agent, or Firm* — Finnegan, Henderson, Farabow, Garrett & Dunner, L.L.P.

(57) ABSTRACT

A mold that can prevent molten metal from leaking out of it as well as from leaking onto a parting plane of the mold. The mold includes a lower mold having a concave portion that has the shape of a product, into which the amount of molten metal required to produce a casting is poured and an upper mold comprising a convex portion that has the shape of the casting, and forming a cavity that molds the casting, when the upper mold overlaps the lower mold. A structure is formed so as to have certain clearances between the lower mold and the upper mold such that molten metal is prevented from leaking onto the parting plane that is formed where the upper mold and the lower mold overlap, when the casting is produced.

13 Claims, 5 Drawing Sheets

U.S. PATENT DOCUMENTS

| | | | | |
|---|---|---|---|---|
| 4,986,944 | A * | 1/1991 | Bertschi | 264/40.5 |
| 5,061,427 | A * | 10/1991 | Hirzel | 264/219 |
| 5,068,065 | A * | 11/1991 | Maus et al. | 264/1.33 |
| 5,348,460 | A * | 9/1994 | Baader | 425/121 |
| 5,620,720 | A * | 4/1997 | Glick et al. | 425/408 |
| 5,925,302 | A * | 7/1999 | Oono et al. | 264/267 |
| 6,158,497 | A * | 12/2000 | Lange et al. | 164/456 |
| 6,405,993 | B1 * | 6/2002 | Morris | 249/141 |
| 6,468,381 | B1 * | 10/2002 | Morgan | 156/244.19 |
| 6,936,213 | B1 * | 8/2005 | Brown | 264/328.1 |
| 7,481,645 | B2 * | 1/2009 | Helou et al. | 425/210 |
| 2003/0067088 | A1 * | 4/2003 | Scolamiero et al. | 264/40.4 |
| 2005/0127565 | A1 * | 6/2005 | Wilson et al. | 264/275 |
| 2006/0198921 | A1 * | 9/2006 | Fujita | 425/542 |
| 2006/0240138 | A1 * | 10/2006 | Broad et al. | 425/412 |
| 2006/0246172 | A1 * | 11/2006 | Koike et al. | 425/595 |
| 2007/0057402 | A1 * | 3/2007 | Da Silva et al. | 264/220 |

FOREIGN PATENT DOCUMENTS

| | | | |
|---|---|---|---|
| JP | 56-050772 | | 5/1981 |
| JP | 59-206133 | | 11/1984 |
| JP | 08-117966 | | 5/1996 |
| JP | 2000263613 | A * | 9/2000 |
| JP | 2005-052871 | | 3/2005 |
| WO | WO 2006015582 | A1 * | 2/2006 |

OTHER PUBLICATIONS

Illustrated Foundry Dictionary, 1st Edition, published by Nikkan Kogyo Sinbunsha, Japan, Nov. 30, 1995,, p. 212.

* cited by examiner

MOLD

TECHNICAL FIELD

This invention relates to a mold. More specifically, it relates to a mold that can prevent molten metal from leaking onto a parting plane, an overlapped surface formed between an upper mold and a lower mold, into which lower mold a required amount of molten metal is poured, and then onto which the upper mold is fitted.

BACKGROUND ART

Conventionally it is considered indispensable in manufacturing a mold that, to obtain a good casting by controlling the flow of molten metal and by restraining any involvement of any impure substance and gas in the product, a passage for the molten metal called a gating system, which has nothing to do with the shape of a casting (see, for example, Non-Patent Publication 1), is provided. However, the gating system often has lowered the yield rate of casting. Moreover, it also requires removing the gating system after crashing the mold. Thus the gating system often worked disadvantageously to the productivity and the cost efficiency of casting.

Therefore, to improve the yield rate for casting, it is proposed to use a molding method wherein it is carried out by using a lower mold, which is a main mold formed by various kinds of molding methods, and which has no gating system, but only a cavity required for casting, and an upper mold, which is a main mold formed by various kinds of molding methods, and has no cavity for a gating system, but which has a protruding portion capable of forming a cavity for casting. In this casting method it is proposed that, after the molten metal required to produce only the casting is poured into the cavity of the lower mold, the protruding portion of the upper mold be advanced into the cavity filled with the molten metal so as to form the cavity required to produce the casting, and that then the upper mold overlap the lower mold.

In the casting method according to the present invention, for the mold that makes unnecessary the work of eliminating, from castings, gating system, feeders etc., that are used in the method based on the gating system plan, a lower mold and a upper mold are disclosed. In this method the lower mold is a main mold formed by various kinds of mold-forming methods, and has no cavity for a gating system, but only a cavity for casting, and the upper mold is a main mold formed by various kinds of mold-forming methods, and has no cavity for a gating system, but has a protruding portion capable of forming a cavity for castings in combination with a cavity of the lower mold. Further also disclosed is adding a flow-off cavity, i.e., a cavity necessary for castings. By adding this flow-off cavity it becomes possible to obtain some tolerance in the amount of such molten metal that is required to produce the casting.

[Non-Patent Publication 1]

Nihon Chuzou Kogakukai (Japan Foundry Engineering Society),

Illustrated Foundry Dictionary, 1st Ed., published by Nikkan Kogyo Sinbunsha, Japan, Nov. 30, 1995, page 212, gating system, and

[Patent Publication 1] Patent Application Publication Gazette No. JP2005-52871

DESCRIPTION OF THE INVENTION

However, in the process of causing the upper mold to overlap the lower mold (hereafter, pressurizing process), of the molding method described above, the amount of the molten metal that is poured into the lower mold is not always equal to the amount that is required. So, a portion of the molten metal may remain unused, depending on the accuracy of the pouring device. Not all of the unused molten metal flows into a flow-off cavity, as described in Patent Publication 1. But some may leak out onto a parting plane of the lower mold. The molten metal that leaks out may form a fin. This raises a problem of adding another process, at a later stage, of removing fins. If the molten metal leaks out in large amount it may form an object extraneous to the pressurizing process, making it difficult to achieve a complete pressurizing of the upper and lower molds.

In view of the above problems, this invention aims to provide a mold that prevents molten metal from leaking onto a parting plane, and at same time prevents molten metal from flowing out of a mold.

The mold of this invention comprises:

a lower mold comprising a concave portion having a shape of a product, into which portion the amount of molten metal required to produce a casting is poured; and, an upper mold comprising a convex portion having the shape of a casting and forming a cavity required to produce a casting, when the upper mold overlaps the lower mold;

wherein a structure is formed so as to have certain clearances between a press-fit portion of the lower mold and a press-fit portion of the upper mold, such that the molten metal is prevented from leaking onto a parting plane formed where the upper mold and the lower mold overlap when producing the casting.

Effects of the Invention

In the present invention, the structure is formed so as to have certain clearances between the press-fit portion of the lower mold and that of the upper mold, such that it prevents the molten metal from leaking. Because of this structure, the kinetic energy of the molten metal is reduced. This prevents the excess molten metal from leaking onto the parting plane, and also from leaking out of the mold in the pressurizing process. This, in turn, reduces fins produced on the castings. Also, defective products due to failures in pressurizing are reduced because excess molten metal is less likely to form an extraneous object on the parting plane in the pressurizing process.

BEST MODE FOR CARRYING OUT THE INVENTION

Figure 1:
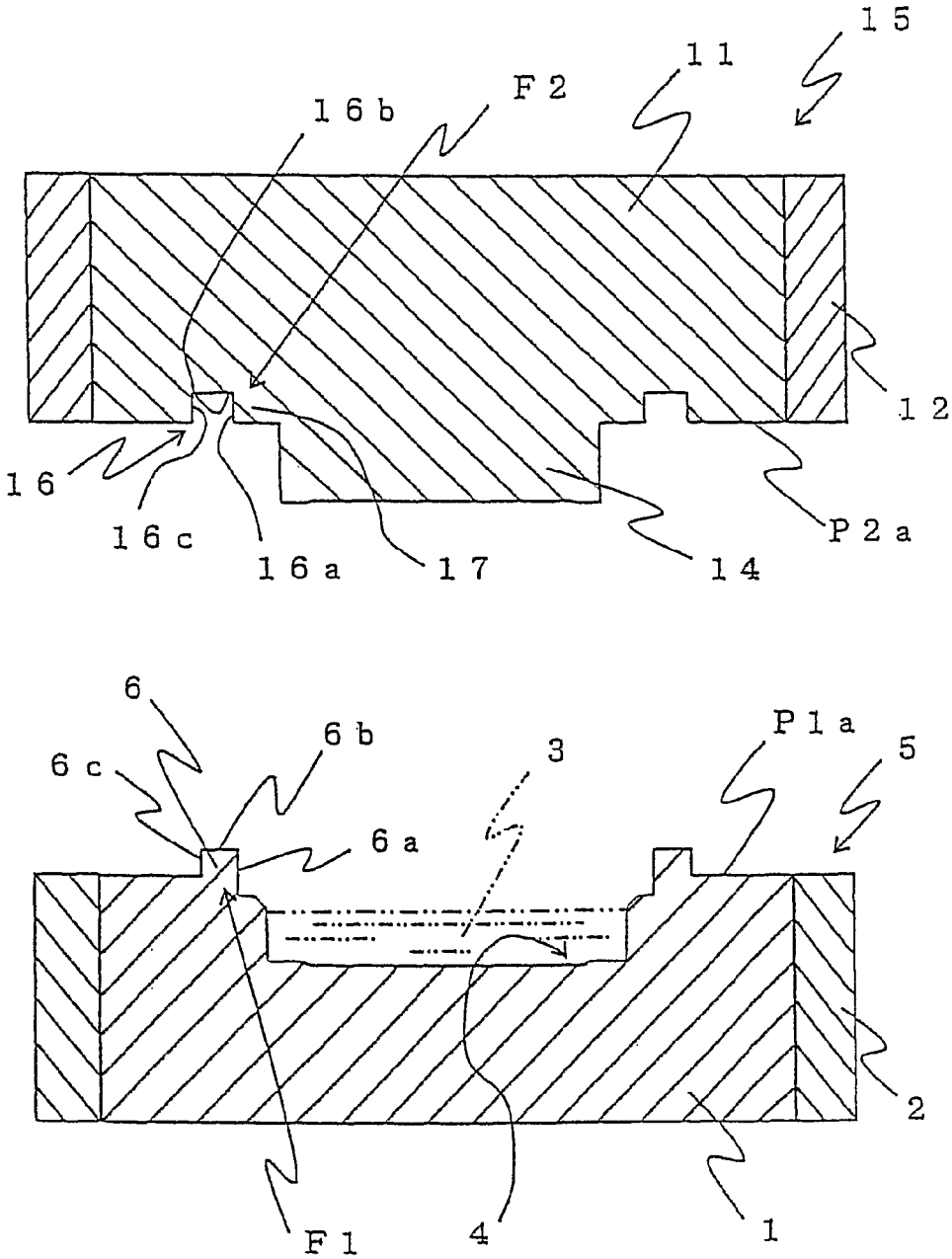
FIG. 1 is a vertical cross section of the lower mold and the upper mold of the mold in one embodiment of the present invention.

The mold according to this invention comprises:

a lower mold comprising a concave portion, into which portion the amount of molten metal required to produce a casting is poured; and an upper mold comprising a convex portion having the shape of the product, which portion forms a cavity that is required to produce a casting, when the upper mold overlaps the lower mold.

The lower mold and the upper mold can be suitably molded by various molding methods, such as a green sand mold, shell mold, cold box molding process, self-hardening mold, and the like. The mold according to the present invention may comprise a core. The mold according to the present invention may also comprise a permanent mold. The mold molding methods according to the present invention are not limited to squeeze molding, blow squeeze molding, air flow and press molding, or a mixture thereof, but comprise molding methods like cut molding, pour molding, and the like. The castings are products with a gating system, such as sprue, runner, ingate, and the like, and a gating system such as riser, flow-off gas vent, or the like, removed from the molded materials that are taken out from the mold after the molding flask is shaken out, such that they can be fitted to or installed in the machine as a final part or component, or can be commercially sold as independent products, such as a round-shaped brake drum or a square case. The molten metals described above are those ferrous or non-ferrous metals in a melted state that can be poured into the mold.

The mold according to the present invention is explained below, based on the Figures. As shown in FIGS. 1 to 4, the mold according to one embodiment of the present invention is comprised of a lower mold 5, which is a main mold molded in a molding flask 2, by a green sand molding method, using green sand 1. The lower mold has a concave portion 4 having the shape of a product, into which portion the amount of molten metal 3 that is required to produce a casting is poured. The mold has an upper mold 15, which is a main mold molded in a molding flask 12, by the green sand molding method, using green sand 11, and which has a convex portion 14, having the shape of the product, which portion forms a cavity 13 with the concave portion 4 of lower mold 5 that is required to produce a casting W.

A structure A is formed so as to have certain clearances (gaps) between the press-fit portion F1 of the lower mold 5 and the press-fit portion F2 of the upper mold 15, such that it prevents molten metal from leaking onto the parting plane Pa formed by the parting plane P1*a* of the lower mold 5 and the parting plane P2*a* of the upper mold 15 when they overlap to produce a casting.

Figure 2:
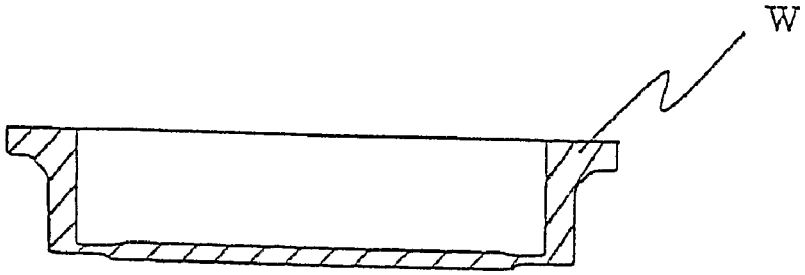
FIG. 2 is a vertical cross section of the casting in one embodiment of the present invention.
Figure 3:
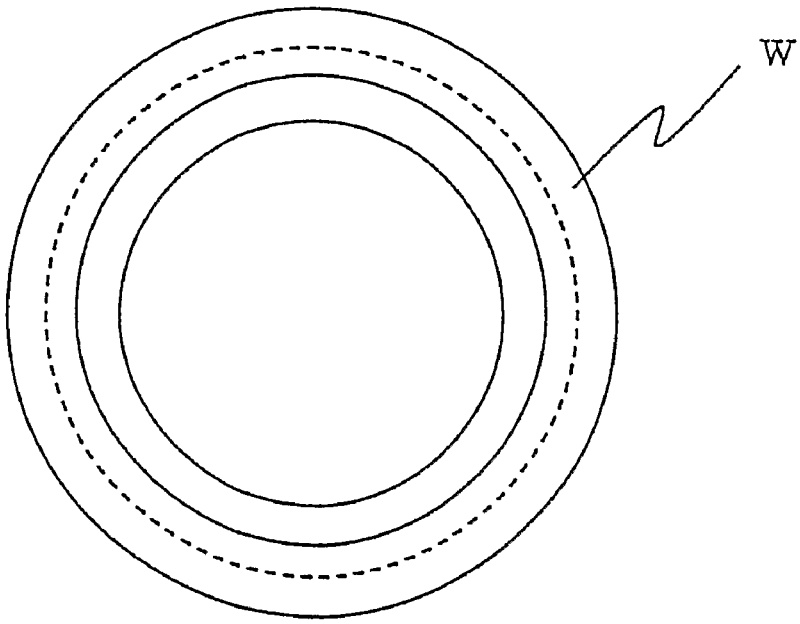
FIG. 3 is a plan view of a casting in one embodiment of the present invention.
Figure 4:
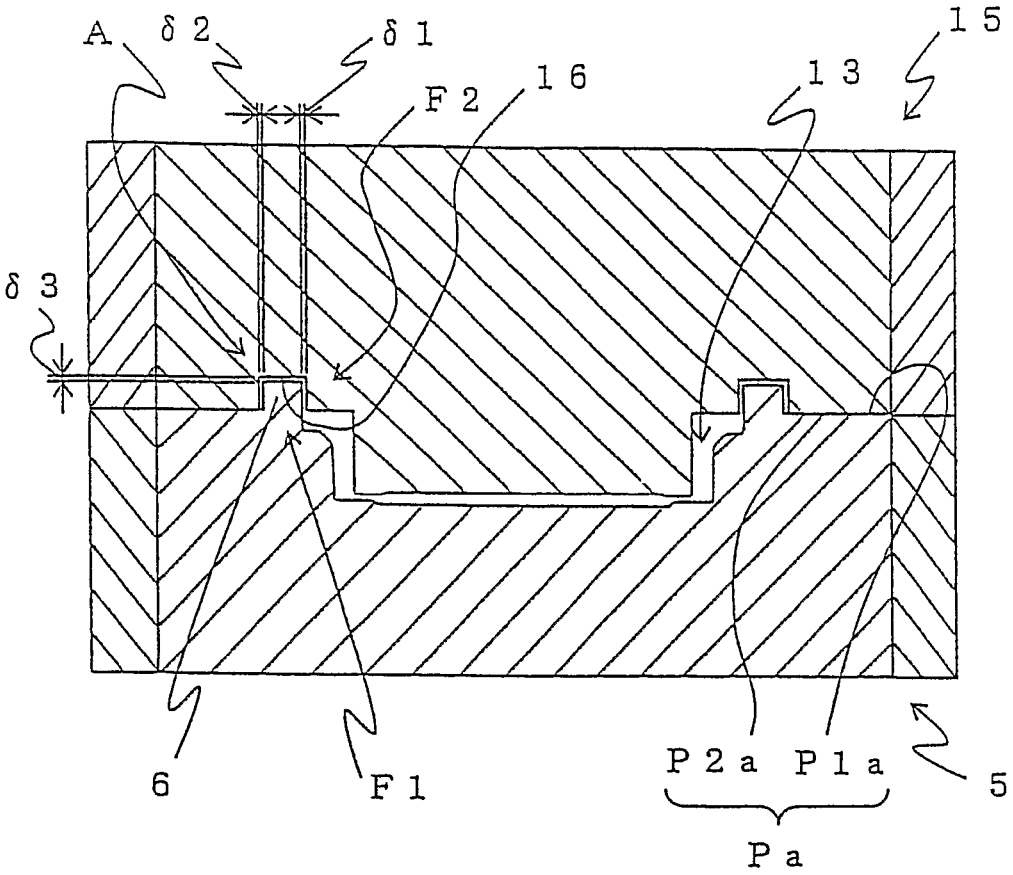
FIG. 4 is a vertical cross-section of the mold of FIG. 1 with the upper mold overlapping the lower mold.
Figure 5:
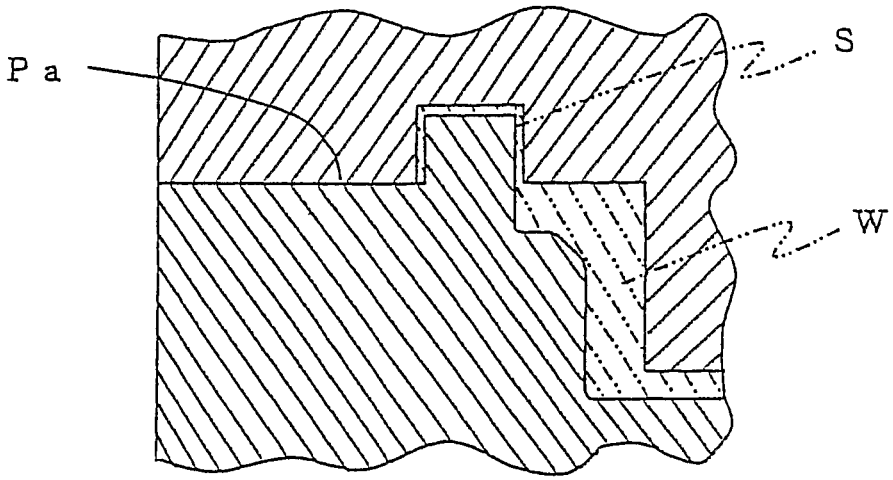
FIG. 5 illustrates metal that has solidified in the clearance.

Structure A, which prevents the molten metal from leaking, comprises a protruding press-fit portion 6, protruding from the parting plane P1*a*, and formed along the outer circumference of the concave portion 4 of the lower mold 5, and a groove portion 16, formed on the upper mold 15, which portion fits with the protruding press-fit portion 6. Thus press-fit portions Fl and F2, according to the embodiment of the present invention, are the protruding press-fit portion 6 and the groove portion 16. The certain clearances (gaps) are clearance δ1 in the horizontal direction, between the side face 6*a* of the protruding press-fit portion 6, and the side face 16*a* of the groove portion 16, which side face is a side face of a press-fit portion 17 positioned close to the outer circumference of the convex portion 14 of the upper mold 15, a clearance δ 2 in the horizontal direction, between the other side face 6*c* of the protruding press-fit portion 6, and the other side face 16*c* of the groove portion 16, and a clearance δ 3 in the vertical direction between the top face 6*b* of the protruding press-fit portion 6, and the bottom face 16*b* of the groove portion 16. These clearances are arranged so as to be in a range of from 0.1 to 4.0 mm. This is because if the clearance were less than 0.1 mm, the upper mold 15 and the lower mold 5 might come into contact with each other. If the clearance were to be more than 4.0 mm, as shown in FIG. 5, a casting W may be affected by a broken casting when metal S, which has become solidified in the clearance, is removed. To make the clearance larger than this is undesirable. The protruding press-fit portion 6 is not limited to any particular shape, so long as it has a shape that surrounds the product along its circumference, or the outer periphery of a square, or the like. In one embodiment of the present invention, the protruding press-fit portion 6 is shown to have a round shape (ring). That shape is most effective in preventing a leakage of molten metal when the casting W has a circular shape in its periphery, as seen in FIGS. 2 and 3. However, in place of this circular shape (ring), a number of pins with a narrow spacing between them or a number of crescents spaced apart that form a ring shape, can also be used.

The shapes of the protruding press-fit portion 6 and the groove portion 16, according to the present invention, are not particularly limited, if they have forms (for example, shapes and dimensions) that are functional, in the pressurized process, in preventing excess molten metal from leaking onto the parting plane Pa, a plane formed by the overlapping of the upper mold and the lower mold. In one embodiment of the present invention, the shapes of the protruding press-fit portion 6 and the groove portion 16 are made close to those of rectangles. These include a square, a trapezoid, and the like, in their cross section perpendicular to a parting plane P1*a* of the lower mold 5 and a parting plane P2*a* of the upper mold 15. The structure thus formed prevents excess molten metal 3 from leaking onto the parting plane Pa because the molten metal 3 either rises towards the upper mold or makes a detour if it should slip through clearances δ1 to δ3 formed by the overlapping of the upper mold 15 and the lower mold 5. However, the molten metal has reduced kinetic energy when it rises (makes a detour) toward the upper mold, and thus its leaking onto the parting plane is easily prevented.

The height of the protruding press-fit portion 6 as measured from the parting plane P1*a* and the depth of the groove portion 16 as measured from the parting plane P2*a* are arranged so as to be in the range of from 5 to 50 mm, while each of the clearances δ1, δ2, and δ3 between the press-fit portion F1 of the lower mold 5 and the press-fit portion F2 of the upper mold 15 is appropriately secured. This is because it is feared that the molten metal 3 may pass through the clearances δ1, δ2 and δ3 and may leak onto the parting plane Pa if both the height and the depth were less than 5 mm. That height is insufficient for having the kinetic energy of the molten metal 3 reduced. If both the height and the depth were more than 50 mm, a problem may arise, in molding a protruding press-fit portion and a groove portion. That is, because if a molding material is not appropriately filled in these areas, then the areas near the convex portion or the corner areas of the protruding press-fit portion and a groove portion may lack strength.

Also, the widths of both the protruding press-fit portion 6 and the groove portion 16, while securing the clearances δ1, δ2, and δ3 between the press-fit portion F1 of the lower mold 5 and the press-fit portion F2 of the upper mold 15, are arranged so as to be in the range of 10 to 50 mm. This is because, if the width were to be less than 10 mm, it is feared that the molten metal 3 that rises could pass straight through the horizontal clearance and could leak onto the parting plane Pa. If the width were to be more than 50 mm the effect of preventing the molten metal from rising and leaking onto the parting plane would be overcome by the deficiency in the strength of the parting plane due to the decrease of the surface area of the parting plane. This strength is essential when the upper and lower molds overlap. Therefore, to make the width more than 50 mm is not desirable.

Figure 6:
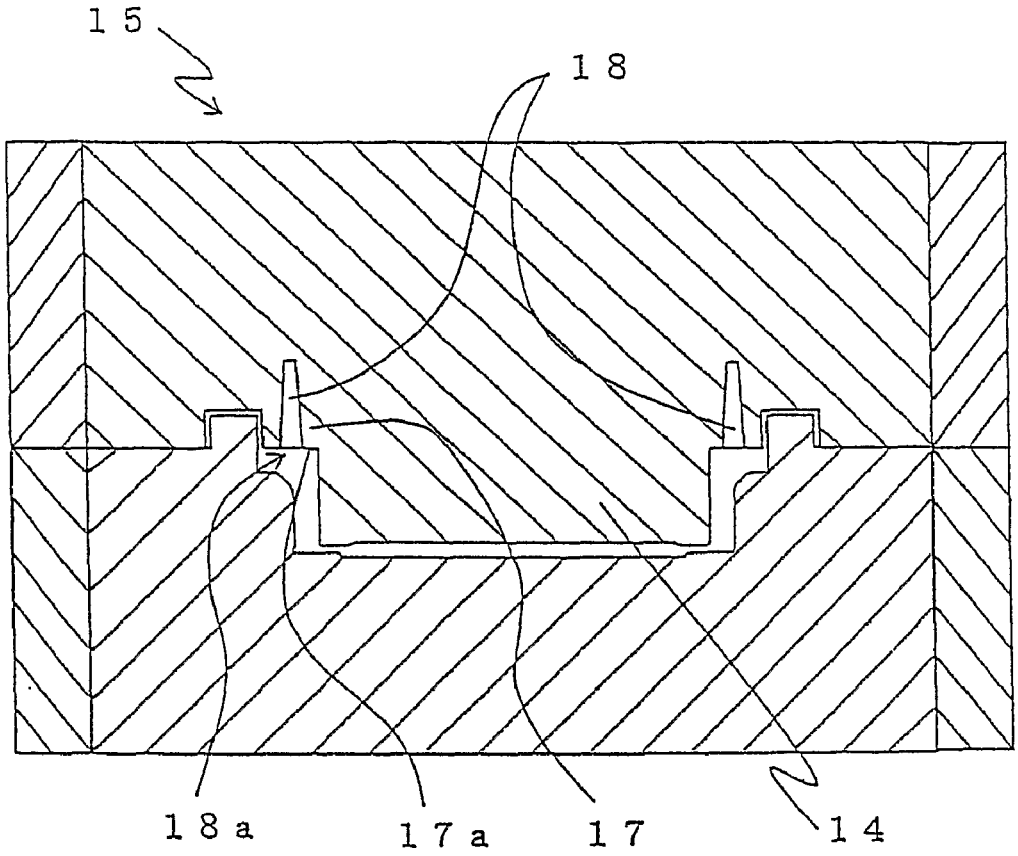
FIG. 6 is a vertical cross section of a mold having a lower mold, and an upper mold having a flow-off hollow formed therein and overlapping the lower mold.
Figure 7:
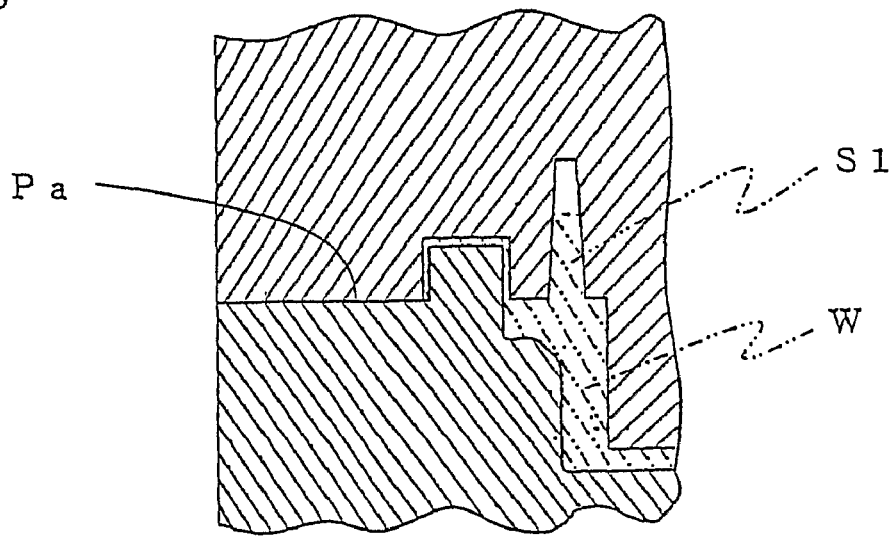
FIG. 7 illustrates the conditions of excess metal as absorbed in the flow-off hollow shown in FIG. 6.

In this embodiment of the present invention, as shown in FIG. 6, a flow-off hollow (cavity) 18 can be formed on a press-fit portion 17 positioned close to the outer circumference of the convex portion 14 of the upper mold 15. The flow-off hollow 18, when formed, can prevent the molten metal from leaking onto or passing over the parting plane Pa and leaking out of the mold, by absorbing excess molten metal S1 that has been disadvantageously left unused, depending on the level of accuracy in the pouring of the pouring machine, from the area where the molten metal is finally poured in the pressurizing process. There can be just one flow-off cavity 18, depending on the amount of excess molten metal, or by changing the shape of a flow-off hollow, and the like. In the embodiment of the present invention, a total of 12 hollows are formed along the circumference of the press-fit portion 17, at equal intervals.

The area ratio of the opening portion 18*a* of the flow-off hollow 18 to the split surface 17*a* of the casting W at the press-fit portion 17 of the upper mold 15 (the area ratio being in the direction of the thickness of the castings W) is preferably 1 to 20% per each of the flow-off hollows 18. This is because if the area ratio were to be more than 20%, the flow-off portion that became solidified in the flow-off hollow would be so thick that it is feared that the casting would suffer a broken casting if the flow-off portion were to be broken off. Also, the casting may be affected by a deformation of the shape at the corner areas of the casting W, where the molten metal is finally reached in the pressurizing process, because the pressurizing force cannot be sufficiently exerted on the molten metal.

The ratio of the weight of the excess molten metal that enters the flow-off hollow 18 to the weight of the molten metal requires to produce the casting W is preferably 1 to 20% per each flow-off hollow 18. This is because if the ratio of the weight were to be more than 20%, an excessive pressure would be applied to the molten metal in a pressurizing process and a problem of penetration would occur with the portion of the casting W where the molten metal is finally reached.

Figure 8:
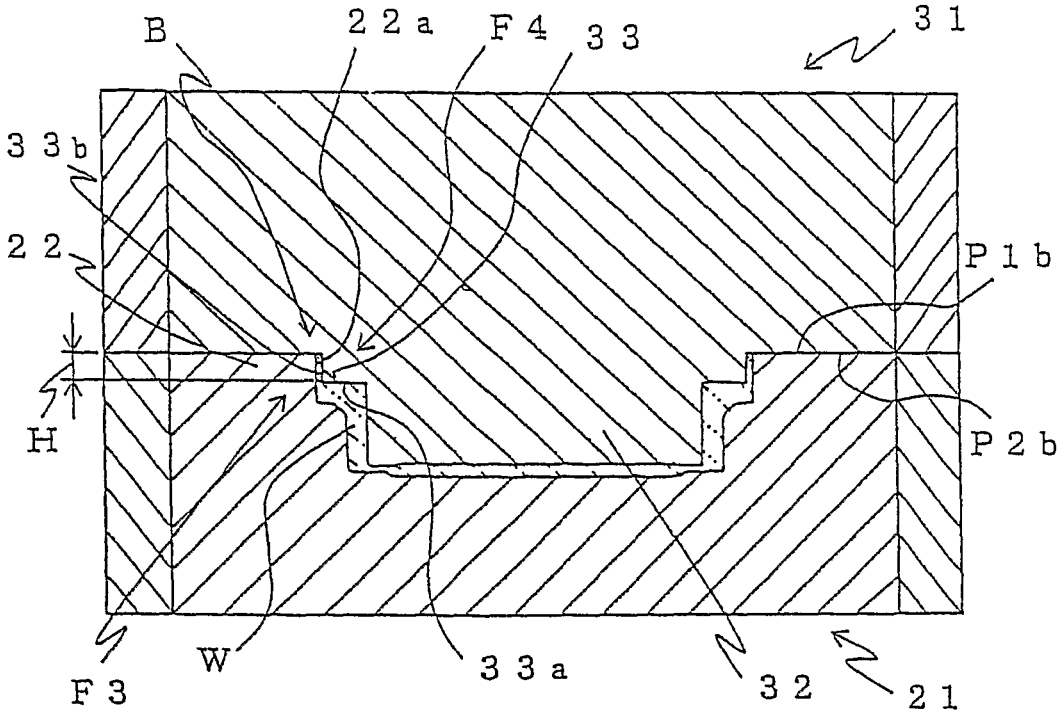
FIG. 8 is a vertical cross section of a mold having a lower mold, and an upper mold overlapping the lower mold in another embodiment of the present invention.

Another embodiment of the present invention is now explained. In the above-mentioned embodiment, Structure A, which prevents any leakage of molten metal, comprises a protruding press-fit portion 6 formed on the lower mold and a groove portion 16 formed on the upper mold. However, in the this embodiment, as shown in FIG. 8, Structure B is formed so as to prevent a leakage of molten metal by having, in the range of 5 to 50 mm, a step H between a split surface 33*a* of the casting W, at the press-fit portion 33, which is close to the circumference of the convex portion 32 of the upper mold 31, and the parting plane P2*b* of the upper mold 31, which is at the outer circumference of the split surface 33*a*. According to this embodiment structure B is simpler than Structure A. Thus it can prevent any leakage on the parting plane when the pouring is performed accurately, and the amount of molten metal is pre-determined. A step H is arranged so as to be in the range of from 5 to 50 mm. If H is less than 5 mm, molten metal may leak onto the parting plane because the height is too low to have the kinetic energy of the molten metal be reduced. If H is more than 50 mm, a casting may be affected by low strength of the convex portion and corner areas of the mold, depending on the complexity of the shapes of the concave portion or the convex portion of the casting, such that when a casting has a higher protrusion and a deeper concave portion the molding material may not be sufficiently filled when the casting is produced.

Also in this embodiment, as in the previous one, a clearance between the press-fit portion F3 of the lower mold 21 and the press-fit portion F4 of the upper mold 31 is arranged so as to be in the range of from 0.1 to 4.0 mm. The press-fit portion F3 of the lower mold 21 of the present embodiment is the upper end (top) portion 22, which forms a parting plane P1 of the lower mold 21. The press-fit portion F4 of the upper mold 31 is a press-fit portion 33 of the upper mold 31. The clearance (gap) is in the horizontal direction between the inner side face 22*a* of the upper-end portion 22 and the press-fit side face 33*b* of the press-fit portion 33 of the upper mold 31.

Figure 9:
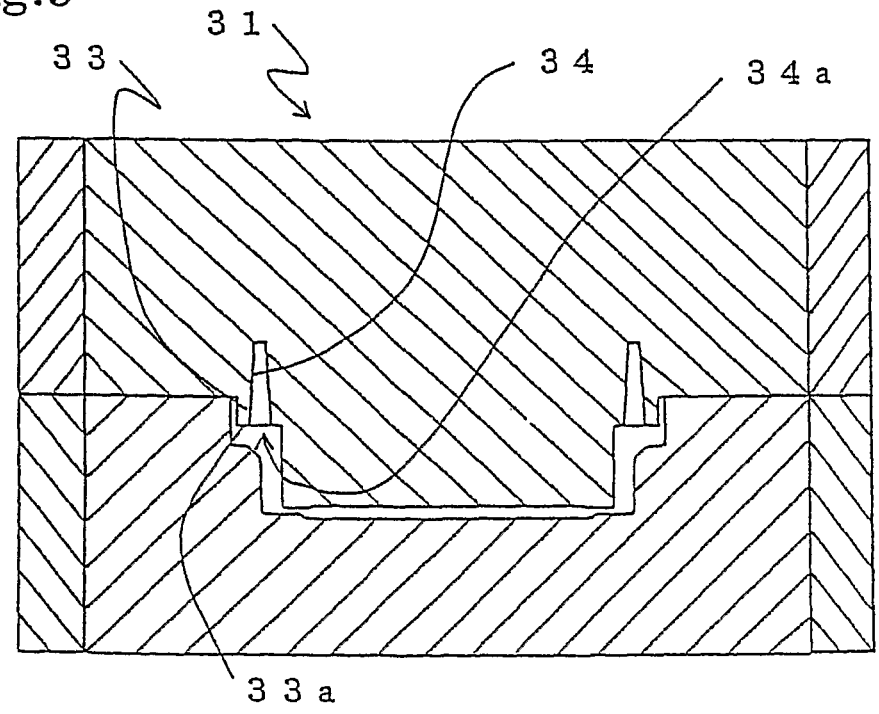
FIG. 9 is a vertical cross-section of the mold of FIG. 8 with the upper mold having a flow-off hollow formed therein and overlapping the lower mold.

In this embodiment of the present invention, as is the case with the previous embodiment, and as shown in FIG. 9, at least one flow-off hollow 34 can be formed on the press-fit portion 33 of the upper mold 31.

The area ratio of the opening portion 34*a* of the flow-off hollow 34 formed on the press-fit portion 33 to the split surface 33*a* of the casting W at the press-fit portion 33 of the upper mold 31 is preferably 1 to 20%.

The ratio of the weight of the excess molten metal that enters the flow-off hollow 34 to the weight of the molten metal required to produce a casting is preferably 1 to 20%.

The invention claimed is:

1. A mold for press molding a casting comprising:

a lower horizontal mold made of sand having a concave portion that has a shape of a casting, into which portion an amount of molten metal required to produce the casting is first poured; and an upper horizontal mold made of sand having a convex portion that has a shape of the casting, the convex portion forming a cavity with the concave portion to form the casting when the upper mold is press fitted down onto and overlaps the lower mold;

wherein a structure is formed between the upper and lower molds so as to have certain clearances between a press-fit portion of the lower mold and a press-fit portion of the upper mold that communicate with the concave and convex portions of the molds so that molten metal can pass into the clearances when the upper mold is press fitted down onto the lower mold to produce the casting to prevent the molten metal from leaking onto a parting plane formed where the upper mold and the lower mold overlap, the press-fit portion of the lower mold of the structure having a protruding press-fit portion protruding from the parting plane and formed along an outer circumference of the concave portion of the lower mold, and the press-fit portion of the upper mold having a groove portion, formed on the upper mold that mates with the protruding press-fit portion when the molds overlap.

2. The mold according to claim 1, wherein at least one flow-off hollow for the molten metal is formed in the press-fit portion of the upper mold which is near an outer circumference of the convex portion of the upper mold.

3. The mold according to claim 1, wherein the clearances between the press-fit portion of the lower mold and the press-fit portion of the upper mold are in a range of from 0.1 to 4.0 mm.

4. The mold according to claim 1, wherein a shape of the protruding press-fit portion and the groove portion are rectangle in cross section and perpendicular to the parting plane of the lower and upper molds.

5. The mold according to claim 1, wherein a height of the protruding press-fit portion as measured from the parting plane and a depth of the groove portion as measured from the parting plane are in a range of from 5 to 50 mm, while the clearances between the press-fit portion of the lower mold and the press-fit portion of the upper mold are maintained.

6. The mold according to claim 1, wherein widths of both the protruding press-fit portion and the groove portion are in a range of 10 to 50 mm, while the clearances between the press-fit portion of the lower mold and the press-fit portion of the upper mold are maintained.

7. The mold according to claim 2, wherein an area ratio of an opening portion of the at least one flow-off hollow to a surface of the press-fit portion of the upper mold which is near the outer circumference of the convex portion of the upper mold is from 1 to 20%.

8. The mold according to claim 2 or 7, wherein a ratio of a weight of excess molten metal that enters the flow-off hollow to a weight of the molten metal required to produce the casting is from 1 to 20%.

9. A mold for press molding a casting by pressing comprising:

a lower horizontal mold made of sand having a concave portion that has a shape of a casting, into which portion an amount of molten metal required to produce the casting is first poured; and an upper horizontal mold made of sand having a convex portion that has a shape of the casting, the convex portion forming a cavity with the concave portion to form the casting when the upper mold is press fitted down onto and overlaps the lower mold;

wherein a structure is formed between the upper and lower molds so as to have certain clearances between a press-fit portion of the lower mold and a press-fit portion of the upper mold that communicate with the concave and convex portions of the molds so that molten metal can pass into the clearances when the upper mold is press fitted down onto the lower mold to produce the casting to prevent the molten metal from leaking onto a parting plane formed where the upper mold and the lower mold overlap, the structure including a step up in the range of from 5 to 50 mm between a split surface of the casting, at the press-fit portion of the upper mold, which is near an outer circumference of the convex portion of the upper mold, and a parting plane of the upper mold, which is farther from an outer circumference of the split surface.

10. The mold according to claim 9, wherein the clearance between the press-fit portion of the lower mold and the press-fit portion of the upper mold is in a range of from 0.1 to 4.0 mm.

11. The mold according to claim 9, wherein at least one flow-off hollow is formed in the press-fit portion of the upper mold which is near an outer circumference of the convex portion of the upper mold.

12. The mold according to claim 11, wherein an area ratio of an opening portion of the flow-off hollow to a split surface of the casting at the press-fit portion of the upper mold which is near the outer circumference of the convex portion of the upper mold is from 1 to 20%.

13. The mold according to claim 11 or 12, wherein a ratio of a weight of excess molten metal that enters the flow-off hollow, to a weight of the molten metal required to produce the casting is from 1 to 20%.

* * * * *